US005641122A

United States Patent [19]

Alkalai et al.

[11] Patent Number: 5,641,122

[45] Date of Patent: Jun. 24, 1997

[54] SPRINKLER

[76] Inventors: Uri Alkalai, 33 Assuta Street, Even Yehuda; Moshe Gorney, Kibbutz Naan, 73 263, both of Israel

[21] Appl. No.: 191,320

[22] Filed: Feb. 2, 1994

[30] Foreign Application Priority Data

Feb. 9, 1993 [IL] Israel ..... 104660

[51] Int. Cl.[6] ..... B05B 3/16

[52] U.S. Cl. ..... 239/206; 239/242

[58] Field of Search ..... 239/201, 203, 239/204, 205, 206, 237, 240, 242, 263.3, 380, 381

[56] References Cited

U.S. PATENT DOCUMENTS

| | | | |
|---|---|---|---|
| 3,523,647 | 8/1970 | Radecki | 239/206 |
| 3,782,638 | 1/1974 | Bumpstead | 239/242 |
| 3,785,565 | 1/1974 | Perry et al. | 239/206 |
| 3,955,764 | 5/1976 | Phaup | 239/206 |
| 4,026,471 | 5/1977 | Hunter | 239/206 |
| 4,220,283 | 9/1980 | Citron | 239/205 |
| 4,234,125 | 11/1980 | Lieding | 239/205 X |
| 4,253,608 | 3/1981 | Hunter | 239/206 |
| 4,316,579 | 2/1982 | Ray et al. | 239/206 X |
| 4,351,477 | 9/1982 | Choi | 239/205 |
| 4,417,691 | 11/1983 | Lockwood | 239/206 |
| 4,624,412 | 11/1986 | Hunter | 239/240 X |
| 4,625,914 | 12/1986 | Sexton et al. | 239/206 |
| 4,681,260 | 7/1987 | Cochran | 239/240 |
| 4,784,325 | 11/1988 | Walker et al. | 239/204 |
| 4,892,252 | 1/1990 | Bruninga | 239/205 |
| 4,925,098 | 5/1990 | Di Paola | 239/206 X |
| 4,927,082 | 5/1990 | Greenberg et al. | 239/381 X |
| 4,972,993 | 11/1990 | Van Leeuwen | 239/206 |
| 5,048,757 | 9/1991 | Van Leeuwen | 239/205 |

*Primary Examiner*—Andres Kashnikow
*Attorney, Agent, or Firm*—Ladas & Parry

[57] ABSTRACT

A pop-up sprinkler including an outer housing defining a water inlet, an inner housing which is raised automatically in response to the supply of water under at least a predetermined pressure, a water driven turbine disposed within the inner housing and driven by water entering the sprinkler via the water inlet, a reducing gear disposed within the inner housing and driven by the water driven turbine and having an output shaft fixed against rotation with respect to the inner housing, whereby operation of the water driven turbine causes the reducing gear to rotate relative to the housing, and a rotatable water outlet fixed to the reducing gear for rotation together therewith relative to the inner housing.

29 Claims, 12 Drawing Sheets

FIG. 6
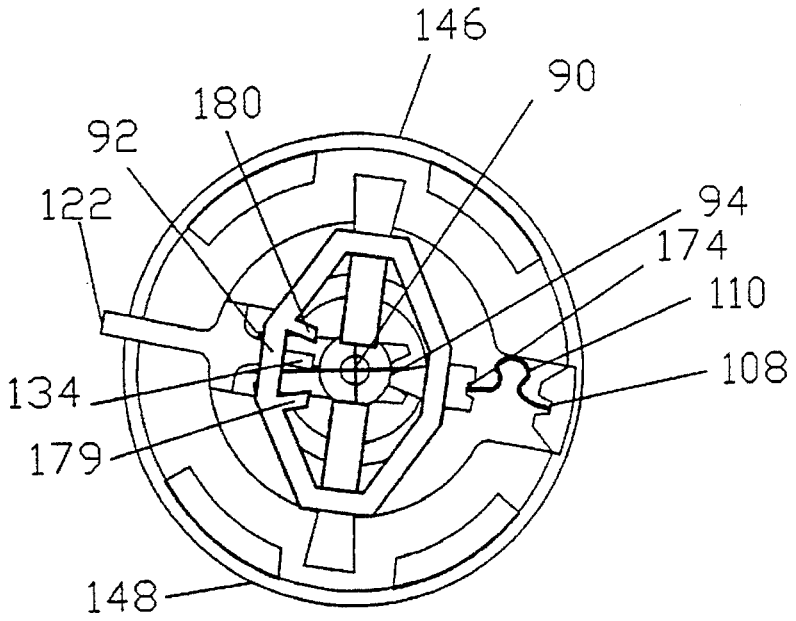
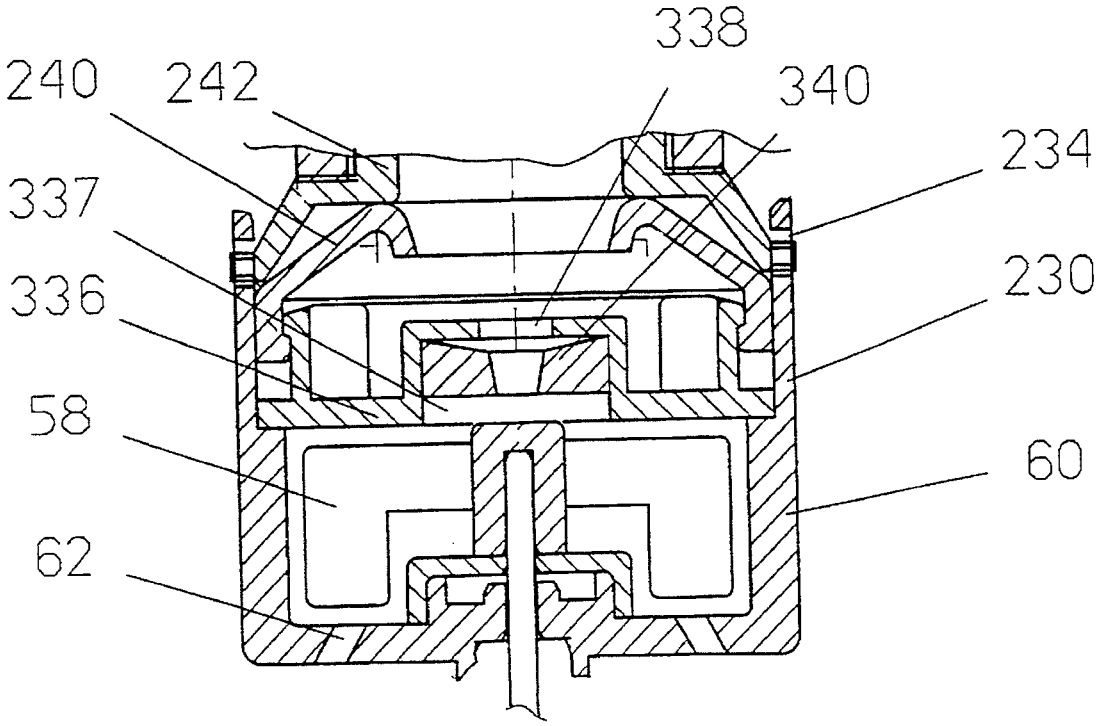
FIG. 11

SPRINKLER

FIELD OF THE INVENTION

The present invention relates to sprinklers generally.

BACKGROUND OF THE INVENTION

The patent literature includes a great variety of sprinklers. Of particular relevance to the present invention are "pop-up" sprinklers and "gear" sprinklers which are exemplified by the following U.S. Pat. Nos.: 4,625,914; 4,892,252; 4,784,325; 3,955,764; 4,026,471; 4,220,283; 4,234,125; 4,253,608; 4,316,579; 4,351,477; 4,417,691; 4,972,993; 4,681,260.

SUMMARY OF THE INVENTION

The present invention seeks to provide an improved sprinkler.

There is thus provided in accordance with a preferred embodiment of the invention a pop-up sprinkler including:

an outer housing defining a water inlet;

an inner housing which is raised automatically in response to the supply of water under at least a predetermined pressure;

a water driven turbine disposed within the inner housing and driven by water entering the sprinkler via the water inlet;

a reducing gear disposed within the inner housing and driven by the water driven turbine and having an output shaft fixed against rotation with respect to the inner housing, whereby operation of the water driven turbine causes the reducing gear to rotate relative to the housing; and a rotatable water outlet fixed to the reducing gear for rotation together therewith relative to the inner housing.

Preferably the reducing gear includes a planetary gear.

Additionally in accordance with a preferred embodiment of the invention there is provided a sprinkler including:

a housing defining a water inlet;

a water driven turbine driven by water entering the sprinkler via the water inlet;

a reducing gear driven by the water driven turbine and having an output shaft fixed against rotation with respect to the housing, whereby operation of the water driven turbine causes the reducing gear to rotate relative to the housing; and a rotatable water outlet fixed to the reducing gear for rotation together therewith, and wherein the reducing gear includes a planetary gear.

Preferably the turbine has at least first and second water inlets whereby water entering the turbine via first and second water inlets produces operation of the turbine in respective first and second opposite rotational directions. The sprinkler also includes water outlet rotation direction selection apparatus for selectably blocking one of the first and second inlets and including first and second elements being mounted for rotation about first and second mutually spaced rotation axes and being interconnected by an over-center spring mechanism, the first and second elements having portions which mutually engage each other at a location intermediate the first and second mutually spaced rotation axes, thereby to ensure desired mutual orientation of the first and second elements even under adverse environmental conditions.

Additionally in accordance with a preferred embodiment of the present invention the first and second elements are arranged for rotation about their respective first and second rotation axes in respective opposite rotational directions, such that at the location intermediate the first and second mutually spaced rotation axes, the portions which mutually engage each other move together in the same direction.

The sprinkler preferably also includes snap fit attachment apparatus for joining the rotatable water outlet to the reducing gear for rotation together therewith.

Additionally in accordance with a preferred embodiment of the present invention, the sprinkler also includes limiting apparatus for governing the amount of water leaving the turbine.

The limiting apparatus may include an element having a water outlet of a fixed size.

Preferably, the limiting apparatus includes a valve element operative to maintain the flow rate of water therepast generally constant notwithstanding pressure variations.

There is additionally provided in accordance with a preferred embodiment of the present invention a sprinkler including:

a housing defining a water inlet;

a rotatable water outlet;

a water driven turbine driven by water entering the sprinkler via the water inlet and being operative to produce rotation of the rotatable water outlet;

a water path between the water inlet and the rotatable water outlet and bypassing the turbine; and limiting apparatus disposed at a water outlet from the turbine and including a valve element operative to maintain the flow rate of water through the turbine generally constant notwithstanding pressure variations.

Further in accordance with a preferred embodiment of the present invention there is provided a sprinkler including:

a housing defining a water inlet;

a water driven turbine driven by water entering the sprinkler via the water inlet and having at least first and second water inlets whereby water entering the turbine via first and second water inlets produces operation of the turbine in respective first and second opposite rotational directions;

a rotatable water outlet driven by the water driven turbine;

water outlet rotation direction selection apparatus for selectably blocking one of the first and second inlets and including first and second elements being mounted for rotation about first and second mutually spaced rotation axes and being interconnected by an over-center spring mechanism, the first and second elements having portions which mutually engage each other at a location intermediate the first and second mutually spaced rotation axes, thereby to ensure desired mutual orientation of the first and second elements even under adverse environmental conditions.

Preferably the first and second elements are arranged for rotation about their respective first and second rotation axes in respective opposite rotational directions, such that at the location intermediate the first and second mutually spaced rotation axes, the portions which mutually engage each other move together in the same direction.

Additionally in accordance with a preferred embodiment of the present invention there is provided a sprinkler including:

a housing defining a water inlet;

a water driven turbine driven by water entering the sprinkler via the water inlet;

a reducing gear driven by the water driven turbine;

a rotatable water outlet; and snap fit attachment apparatus for joining the rotatable water outlet to the reducing gear for rotation together therewith.

The sprinkler preferably also includes a water supply pipe and wherein the snap fit attachment apparatus is coupled between the water supply pipe and the rotatable water outlet.

Preferably the snap fit attachment apparatus includes a water sealing connection upstream of the water supply pipe.

The above described sprinklers may also include apparatus for selectably governing the direction of rotation of the rotatable water outlet and including:

a selector;

a link pivotable about a rotation axis fixed with respect to the turbine housing; and a spring operative to urge the link into an engagement orientation whereby it pivots about the rotation axis, and wherein forced relative rotation between at least two of the selector, the rotatable outlet and the housing forces the link against the urging of the spring and out of the engagement orientation with the rotation axis, and thus out of engagement with the selector, thereby preventing breakage of the link and the selector.

Further in accordance with a preferred embodiment of the present invention there is provided a sprinkler including:

a housing defining a water inlet;

a water driven turbine driven by water entering the sprinkler via the water inlet and including a turbine housing;

a rotatable water outlet driven by the water driven turbine; and apparatus for selectably governing the direction of rotation of the rotatable water outlet and including:

a selector;

a link pivotable about a rotation axis fixed with respect to the turbine housing; and a spring operative to urge the link into an engagement orientation whereby it pivots about the rotation axis, and wherein forced relative rotation between at least two of the selector, the rotatable outlet and the housing forces the link against the urging of the spring and out of the engagement orientation with the rotation axis, and thus out of engagement with the selector, thereby preventing breakage of the link and the selector.

The sprinkler may also include apparatus for selectably governing the direction of rotation of the rotatable water outlet and including:

a pair of mutually rotatable selectors, including the link which is pivotable about a rotation axis fixed with respect to the turbine housing;

a spring operative to urge the link into an engagement orientation whereby it pivots about the rotation axis, and wherein predetermined relative rotation between the selectors forces the link against the urging of the spring and out of the engagement orientation with the rotation axis; and apparatus for retaining the link out of the engagement orientation, and thus out of engagement with the selectors, during normal working operation, thereby providing full circle sprinkler operation.

Further in accordance with a preferred embodiment of the present invention there is provided a sprinkler including:

a housing defining a water inlet;

a water driven turbine driven by water entering the sprinkler via the water inlet and including a turbine housing;

a rotatable water outlet driven by the water driven turbine; and apparatus for selectably governing the direction of rotation of the rotatable water outlet and including:

a pair of mutually rotatable selectors, including the link which is pivotable about a rotation axis fixed with respect to the turbine housing;

a spring operative to urge the link into an engagement orientation whereby it pivots about the rotation axis, and wherein predetermined relative rotation between the selectors forces the link against the urging of the spring and out of the engagement orientation with the rotation axis; and apparatus for retaining the link out of the engagement orientation, and thus out of engagement with the selectors, during normal working operation, thereby providing full circle sprinkler operation.

BRIEF DESCRIPTION OF THE DRAWINGS

The present invention will be more fully understood and appreciated from the following detailed description, taken in conjunction with the drawings in which:

FIG. 6 is a downward facing view of the apparatus of FIG. 2, taken generally along lines VI—VI in FIG. 1;

FIG. 11 is a sectional side view illustration of part of a modified version of the apparatus of FIG. 10;

DETAILED DESCRIPTION OF A PREFERRED EMBODIMENT

Figure 1:
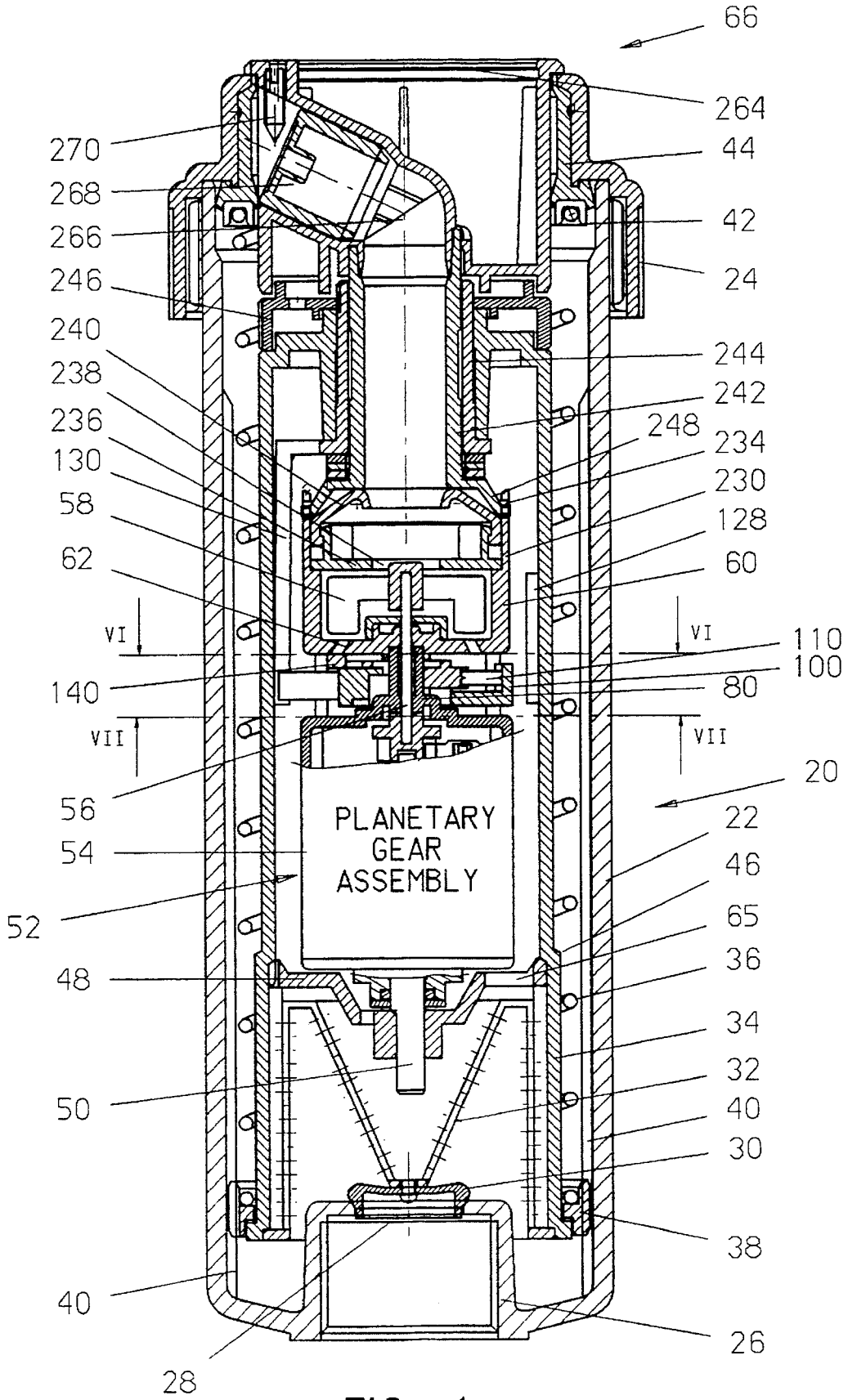
FIG. 1 is a partially cut away, partially sectional illustration of a sprinkler constructed and operative in accordance with a preferred embodiment of the present invention.

Reference is now made to FIG. 1, which illustrates a "pop-up" sprinkler constructed and operative in accordance with a preferred embodiment of the present invention. The sprinkler, designated generally by reference numeral 20 comprises an outer housing 22 and a top collar member 24 which is fixedly attached to housing 22.

Housing 22 is formed at a bottom end thereof with a threaded water inlet portion 26 having an outlet 28 onto which is seated a closure element 30. Closure element 30 may be rigid or flexible and is generally rigidly mounted via a screen filter assembly 32 onto a generally cylindrical extendible chassis 34.

Chassis 34 is located within housing 22 and surrounded by a compression spring 36 which is seated at one end on a retaining ring 38, which is retained against rotation with respect to housing 22 by means of a plurality of elongate ribs 40. Retaining ring 38 permits forced rotation of chassis 34 with respect thereto.

Spring 36 is seated at its opposite end onto a retaining ring 42, which is fixed via a sealing collar 44 to collar 24. Spring 36 is operative to urge chassis 34 downward in the sense of FIG. 1 such that inter alia, closure 30 seals opening 28. This arrangement ensures that water under a predetermined threshold pressure does not pass through opening 28 and operate the sprinkler in a non-desired mode of operation.

When sufficient water pressure, such as for example, 1 Bar, is present, the water in inlet 26 forces closure 30 out of engagement with opening 28, against the urging of spring 36. In practice, during normal operation of the sprinkler, the water pressure is sufficient to raise chassis 34 to an extent such that a shoulder 46 formed on the outside surface of chassis 34 engages ring 42.

Fixedly mounted within chassis 34 and retained against rotation relative to the chassis by means of a mounting element 48 is the output shaft 50 of a gear assembly 52. Gear assembly 52 is preferably a multi-stage planetary gear assembly of conventional overall design which is arranged for operation such that its housing 54 rotates relative to chassis 34 and wherein the output shaft 50 is connected to the planetary gears via a clutch.

Figure 7A:
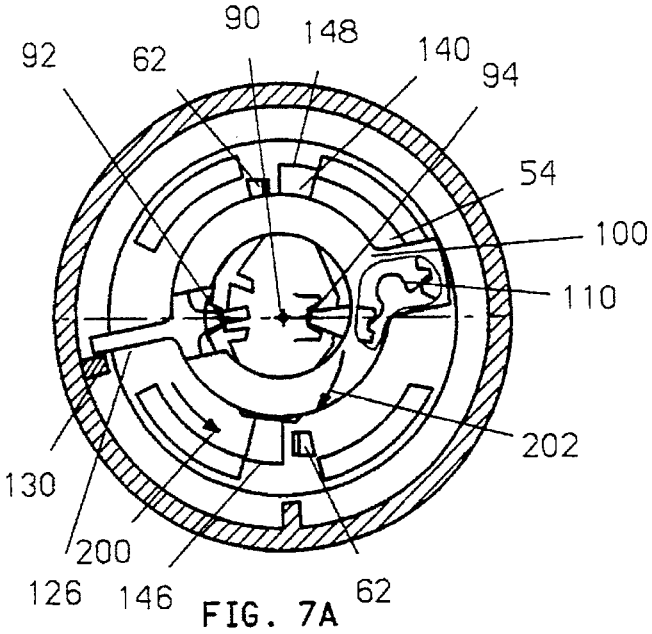
FIGS. 7A, 7B and 7C are three simplified illustrations of the apparatus shown in FIG. 6, taken generally in a direction indicated by arrows along lines VII—VII in FIG. 1, in three different operational stages.
Figure 7B:
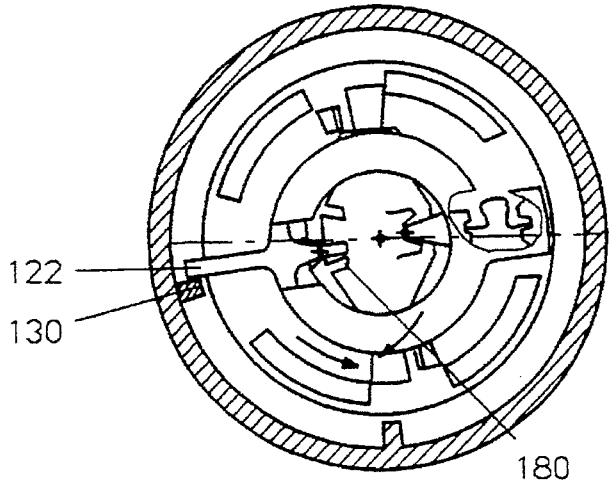
Figure 7C:
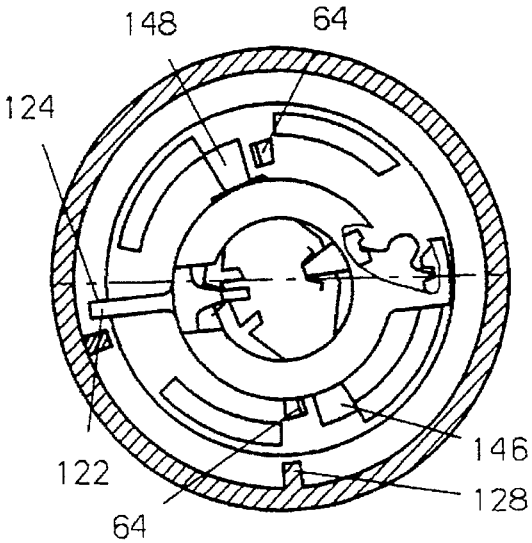

The input shaft 56 of gear assembly 52 is directly coupled to a water driven turbine 58 which is located within a housing 60 having two alternative sets of angled water inlets 62 and 64 respectively, which are seen in FIGS. 7A–7C, and which provide rotation of the turbine in respective opposite directions.

Disposed intermediate gear assembly 52 and housing 60 is a direction changing assembly, which is described hereinbelow in detail in connection with FIGS. 2–8C.

The rotation of housing 54 is transmitted to housing 60 for rotating the output of the sprinkler by a linkage which is described hereinbelow in connection with FIG. 2.

A sprinkler head assembly 66 is tiltably mounted for rotation together with housing 60 as described hereinbelow in connection with FIGS. 9–10B.

During operation of the sprinkler, pressurized water forces chassis 34 to move upward with respect to housing 22 in the sense of FIG. 1, against the urging of spring 36 until shoulder 46 engages ring 42. With the chassis 34 in the raised position, the sprinkler head assembly 66 is raised to an operative orientation.

Water entering through inlet 26, passes through filter 32 and through apertures 65 formed in mounting element 48. The water passes along the interior of the chassis 34 on the outside of housing 54 and to the extent not blocked, enters housing 60 via angled inlets 62 and 64. The water drives the turbine 58 in a direction which is determined by which pairs of inlets 62 and 64 are unblocked.

The turbine 58 rotates shaft 56 which, via the planetary gear assembly 52 provides reduced speed rotation of housing 54, due to the fixing of output shaft 50 with respect to the chassis 34. Housing 54 is coupled to the sprinkler head assembly 66 for rotation together therewith.

Figure 2:
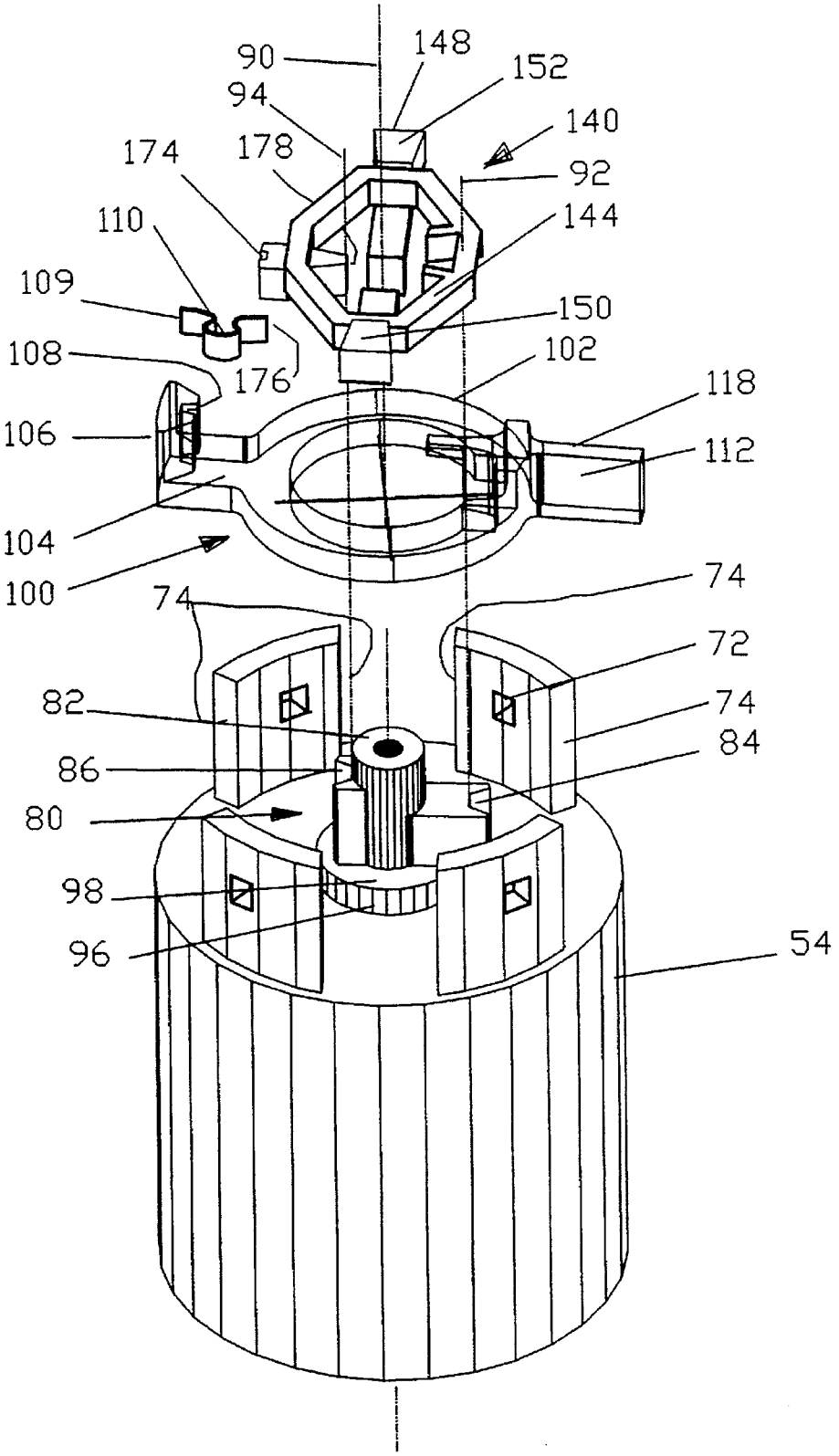
FIG. 2 is a simplified exploded view illustration of apparatus for changing the direction of water flow through the sprinkler drive turbine forming part of the sprinkler of FIG. 1.
Figure 3:
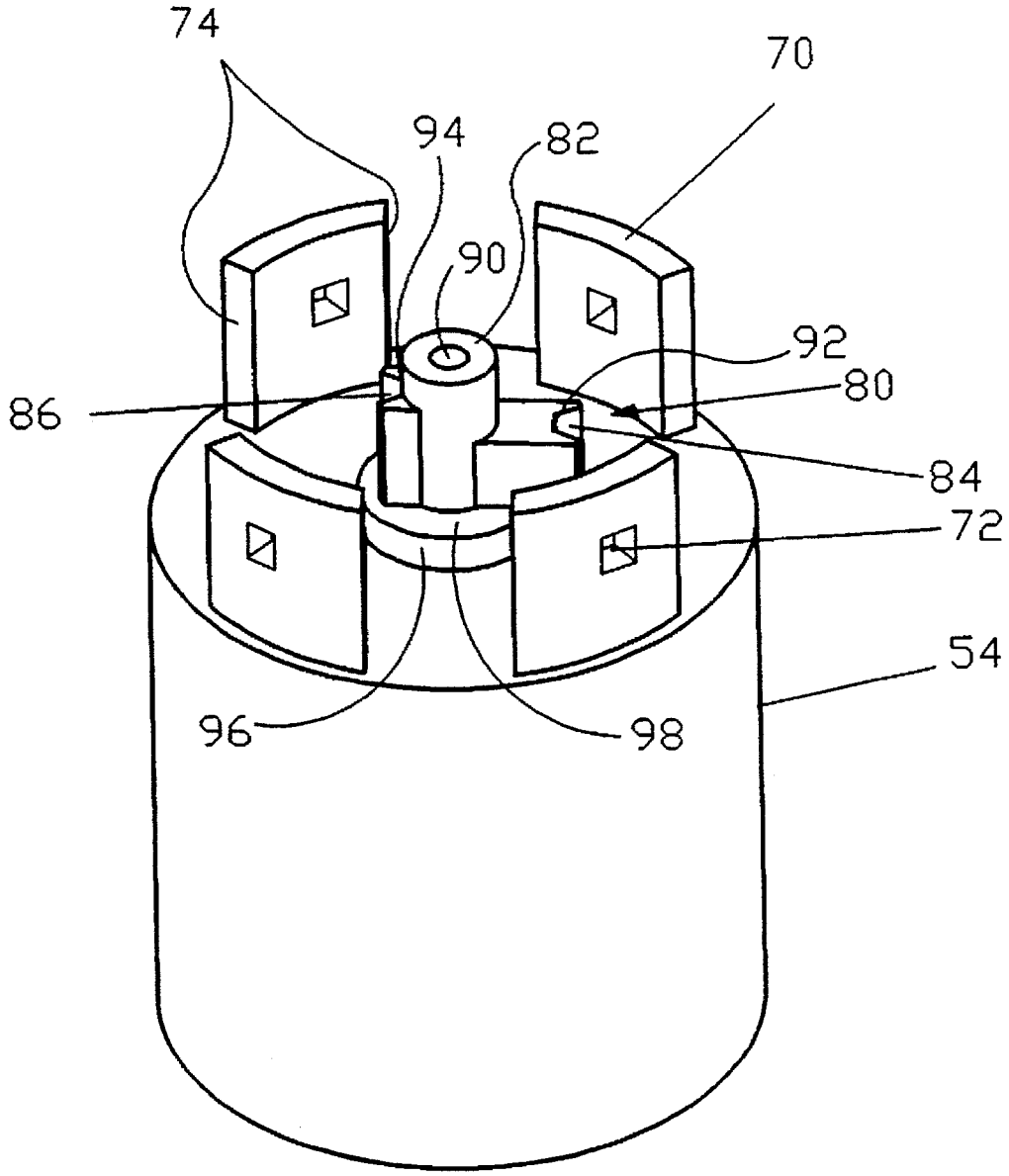
FIG. 3 is a simplified illustration of base portion of the apparatus of FIG. 2 which also defines part of the gear housing.

Reference is now made to FIGS. 2–8C, which illustrate the structure and operation of the direction changing assembly. FIGS. 2 and 3 illustrate gear assembly housing 54 and show upwardly directed peripheral tooth members 70 which include engagement apertures 72 which are engaged by corresponding teeth (not shown) integrally formed with housing 60, for transmission of the rotation of housing 54 to housing 60.

The peripheral edges 74 of tooth members 70 also define stop surfaces for engagement by elements of the direction changing assembly as will now be described.

Surrounding and rotatable with respect to input shaft 56 and integrally formed with housing 54 is a collar portion 80. Collar portion 80 defines a top surface 82 which is typically seated in a recess formed on the underside of housing 60 for rotation together with housing 60.

Collar portion 80 also defines a pair of laterally facing notches 84 and 86 which define mutually parallel axes which lie parallel to and laterally spaced from the axis of input shaft 56. For clarity, the axis of input shaft 56 is designated by reference numeral 90, while the axis of notch 84 is designated by reference numeral 92 and the axis of notch 86 is designated by reference numeral 94.

Disposed beneath a portion of collar portion 80 is a generally circular platform 96 which is centered about axis 90 and which defines a top surface 98.

Figure 4A:
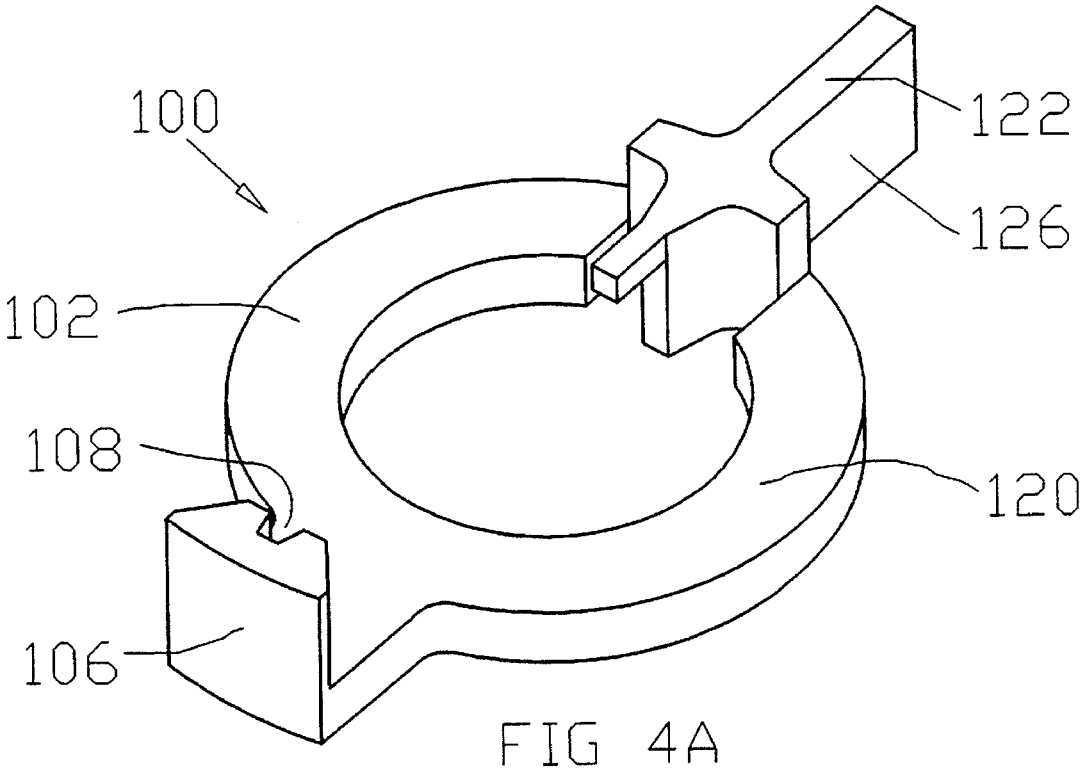
FIGS. 4A and 4B are pictorial illustrations of a link forming part of the apparatus of FIG. 2 seen from differing perspectives.
Figure 4B:
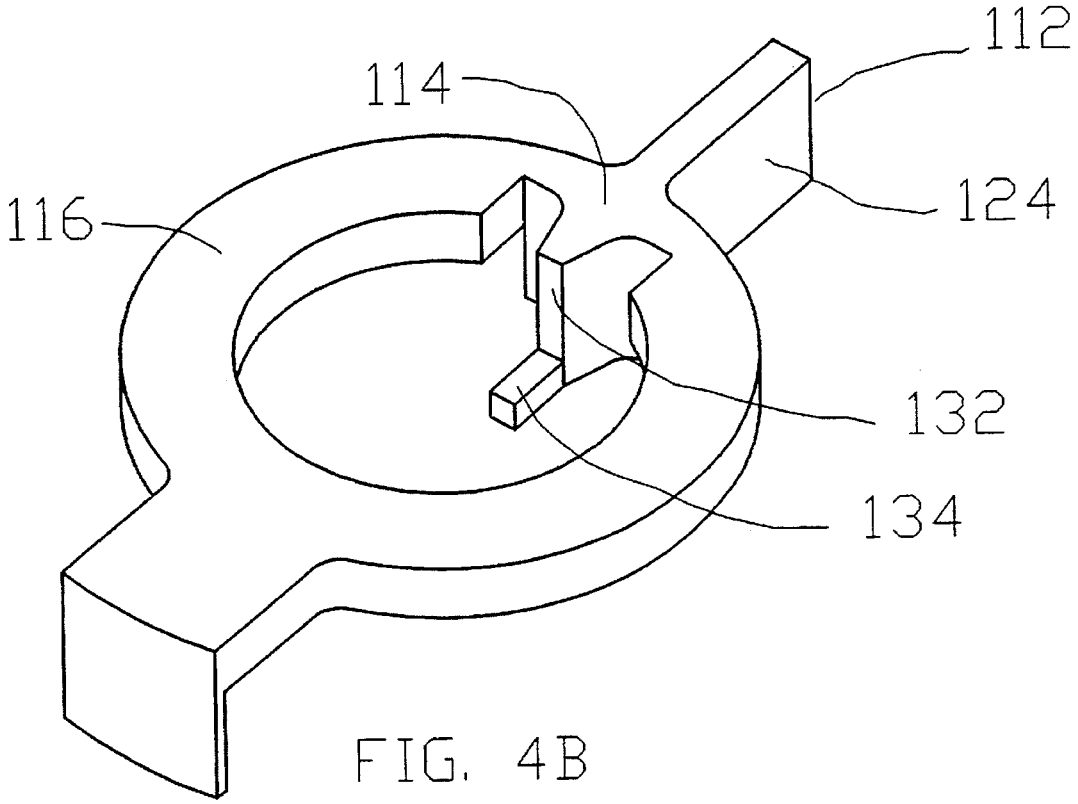

Arranged for operative engagement with the base portion illustrated in FIG. 3 is a link 100, shown in detail in FIGS. 4A and 4B, which comprises a generally circular flat ring portion 102 having a first protrusion 104 coplanar therewith from which extends a perpendicularly directed arm 106 having an inwardly facing notch 108, which serves as a spring seat for a first end 109 of a spring 110 (FIG. 2).

Integrally formed with ring portion 102 and extending therefrom in a direction opposite to protrusion 104 is a second protrusion 112 having a bottom surface 114 coplanar with the bottom surface 116 of ring portion 102 and a top surface 118 extending above the top surface 120 of ring portion 102.

Second protrusion 112 comprises a generally rectangular portion 122 having side walls 124 and 126 which, depending on the azimuthal orientation of link 100 relative to chassis 34, operatively engage an inner facing rib 128 fixed to chassis 34.

Side walls 124 and 126 also intermittently engage an arm 130, whose structure and function are described hereinbelow.

Second protrusion 112 defines an inward facing surface 132 that is arranged to seat in notch 84 of collar 80 and to lie along axis 92. Extending inwardly from surface 132 along top surface 118 of the second protrusion 112 is a finger 134.

Figure 5A:
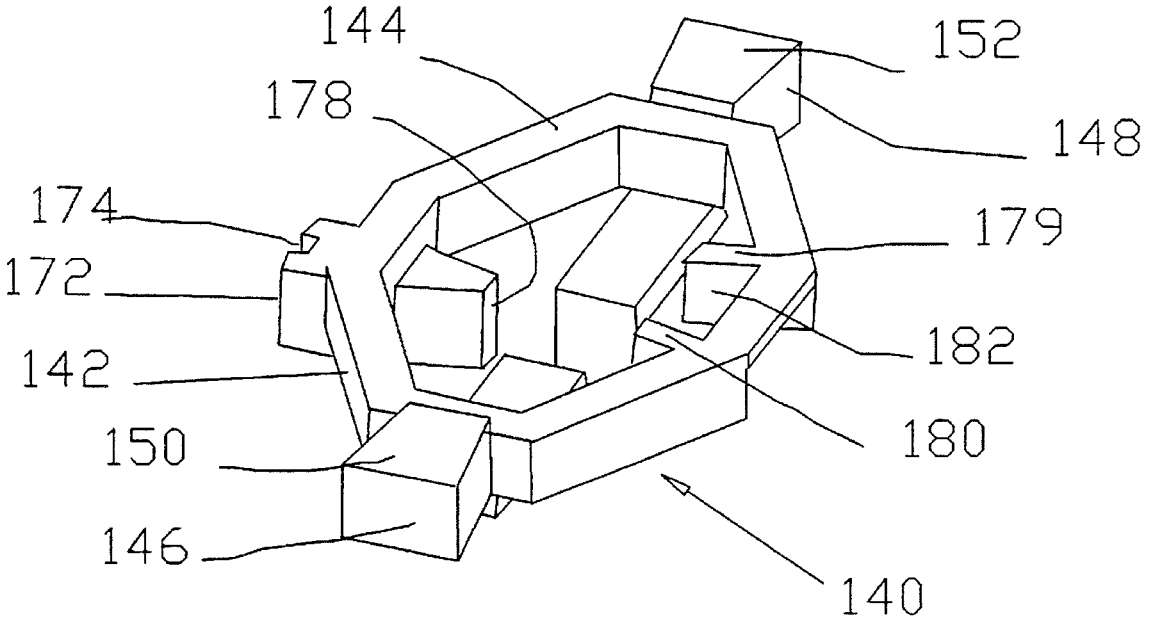
FIGS. 5A and 5B are pictorial illustrations of a flow controlling element forming part of the apparatus of FIG. 2 seen from differing perspectives.
Figure 5B:
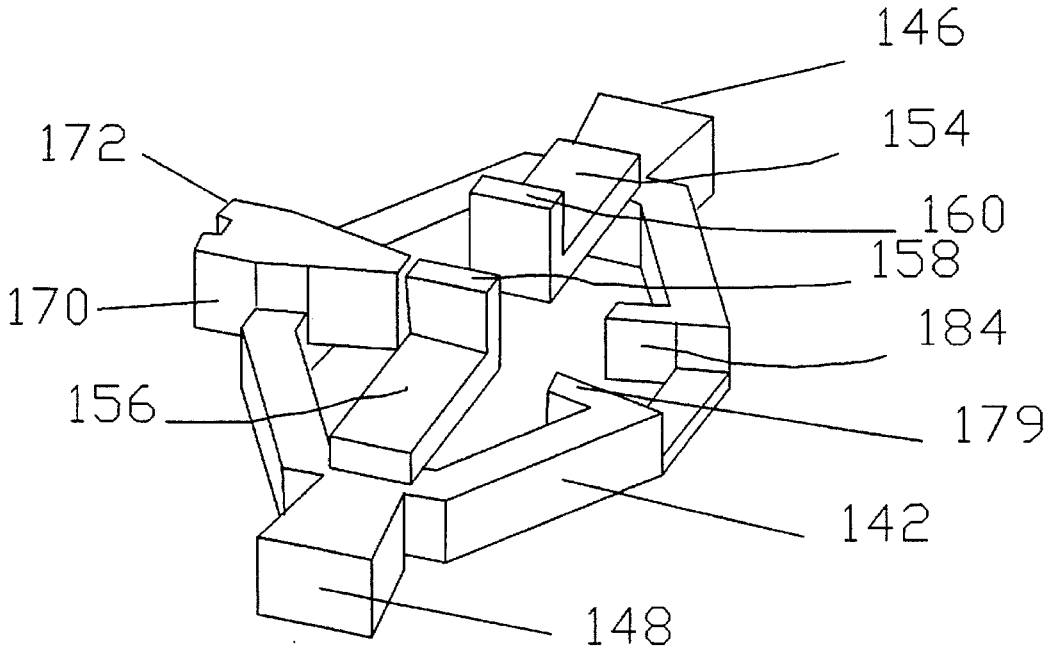

Arranged for operative engagement with link 100 and with the base portion illustrated in FIG. 3 is a flow controlling element 140, which is illustrated in detail in FIGS. 5A and 5B.

Flow controlling element 140 comprises a generally elliptical flat ring portion 142 having a uniform top surface 144. Extending outwardly from flat ring portion 142 along the principal axis of the ellipse defined thereby are third and fourth protrusions 146 and 148 which define respective top surface portions 150 and 152 which are brought into operative blocking engagement with one or the other pairs of water inlets 62 and 64.

Extending inwardly from ring portion 142 at protrusions 146 and 148 are respective inwardly directed spring-like portions 154 and 156 each of which terminate in a downwardly extending end portion, designated 158 and 160 respectively. End portions 158 and 160 engage top surface 98 of platform 96 so as to urge flow controlling element 140 upwardly against housing 60, for effective sealing of water inlets 62 and 64 by surfaces 150 and 152 of protrusions 146 and 148 respectively.

Extending inwardly and outwardly from ring portion 142 at a location intermediate protrusions 146 and 148 is a fifth protrusion 170. The outward facing end 172 of protrusion 170 is formed with a notch 174 which defines a spring seat for a second end 176 of spring 110 (FIG. 2).

The inward facing end 178 of protrusion 170 is arranged to seat in notch 86 of collar 80 and to lie along axis 94.

Arranged generally opposite protrusion 170 are a pair of inwardly facing portions 179 and 180 having mutually facing respective surfaces 182 and 184.

The interaction and operation of the direction changing assembly will now be described with reference to FIGS. 6, 7A–7C and 8A–8C together with FIG. 2.

Link 100 and flow controlling element 140 are seen to be supported onto housing 54 in the following manner: Spring 110 which is seated between respective notches 108 on link 100 and 174 on element 140. Spring 110 is a compression spring and thus urges surface 178 of element 140 against notch 86 of collar 80, which is integrally formed with housing 54. Surface 132 of link 100 is simultaneously urged by spring 110 against notch 84 of collar 80.

As seen in FIG. 7A, at an arbitrary initial stage, protrusions 146 and 148 block the pair of inlets 64, producing housing rotation typically in a counterclockwise direction in the sense of FIGS. 7A–7C and 8A–8C about axis 90, as indicated by arrow 200. This counterclockwise rotation of housing 54 causes surface 126 of portion 122 of protrusion 112 to engage arm 130 causing clockwise rotation of link 100 about axis 92 with respect to housing 54, as indicated by arrow 202.

It can be seen that due to the orientation of the spring 110 in FIG. 7A, during the clockwise rotation of link 100 about axis 92, described above, spring 110 urges element 140 in clockwise rotation about axis 94. At a certain point in the clockwise rotation of link 100, which is illustrated in FIG. 7B, the orientation of spring 110 passes an "over-center" point.

Once spring 110 passes the "over-center" point illustrated in FIG. 7B, continued counterclockwise rotation of housing 54 combined with the action of spring 110 causes element 140 to "jump" in counterclockwise rotation about axis 94 and similarly causes link 100 to "jump" in clockwise rotation about axis 92 so that their relative orientations are as shown in FIG. 7C.

The counterclockwise rotation of element 140 about axis 94 causes element 140 to shift its position with respect to inlets 62 and 64 such that protrusions 146 and 148 unblock inlets 64 and block inlets 62.

This, in turn, causes the direction of water impinging on the turbine to become opposite and thus causes rotation of the housing 54 in an opposite direction to its previous direction of rotation, i.e. clockwise, in the present example.

The clockwise rotation of housing 54 continues until after surface 124 of portion 122 of protrusion 112 engages rib 128, causing an operation similar to that described hereinabove in connection with FIGS. 7A–7C, resulting in another shift of direction of rotation of housing 54, back to counterclockwise, in the present example.

Figure 8A:
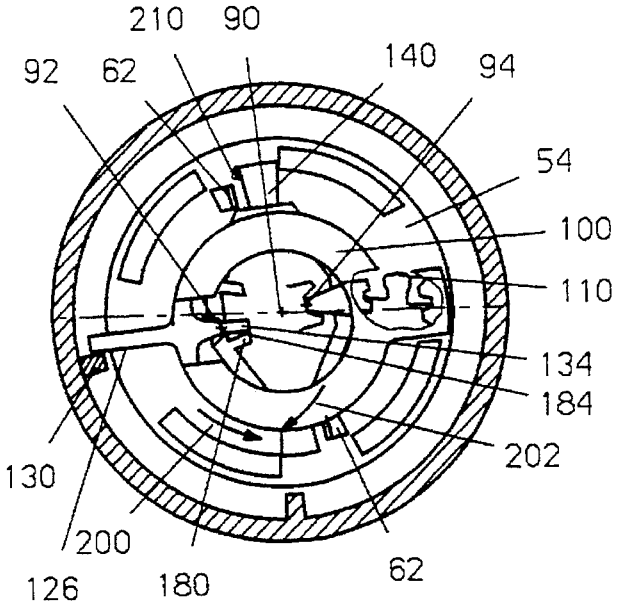
FIGS. 8A, 8B and 8C are three simplified illustrations of the apparatus shown in FIG. 6, taken generally in a direction indicated by arrows along lines VII—VII in FIG. 1, in three different operational stages in the presence of spurious particles inside the sprinkler.
Figure 8B:
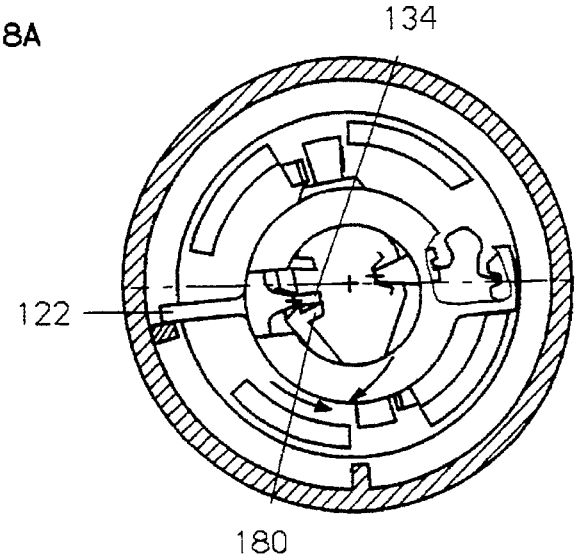
Figure 8C:
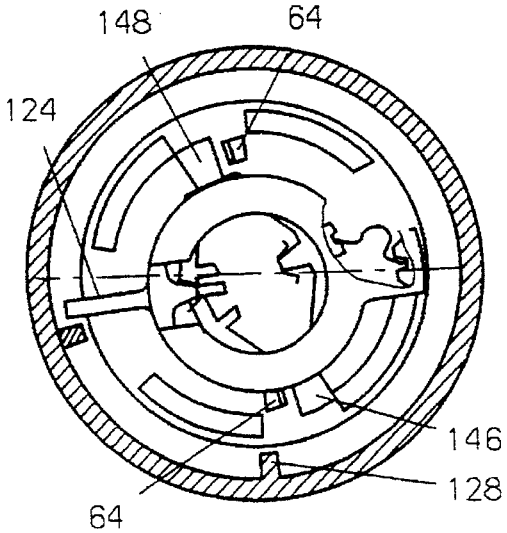

Reference is now made to FIGS. 8A–8C, which illustrate the operation described hereinabove in connection with FIGS. 7A–7C in the presence of spurious particles 210 at the various engaging surfaces of element 140 and housing 60 or at other locations which impede the otherwise free motion of element 140.

FIG. 8A illustrates a stage after the stage shown in FIG. 7B, but where the presence of spurious particles 210 or any other interference, prevents the "jump" of element 140 in counterclockwise motion in response to the urging of spring 100, following passage of its "over-center" point.

In this case finger 134 of link 100 engages surface 184 of portion 180 of element 140 and positively urges element 140 in counterclockwise rotation about axis 94, as illustrated in FIG. 8B, thus causing element 140 to assume the orientation of FIG. 8C, which is same orientation as in FIG. 7C, notwithstanding the impediment to its free motion.

It is noted that the orientation of link 100 in FIG. 8C is more counterclockwise than the corresponding orientation of link 100 in FIG. 7C, indicating that the direction change in cases where the motion of element 140 is somewhat impeded, takes place at a somewhat later stage than otherwise.

Figure 9:
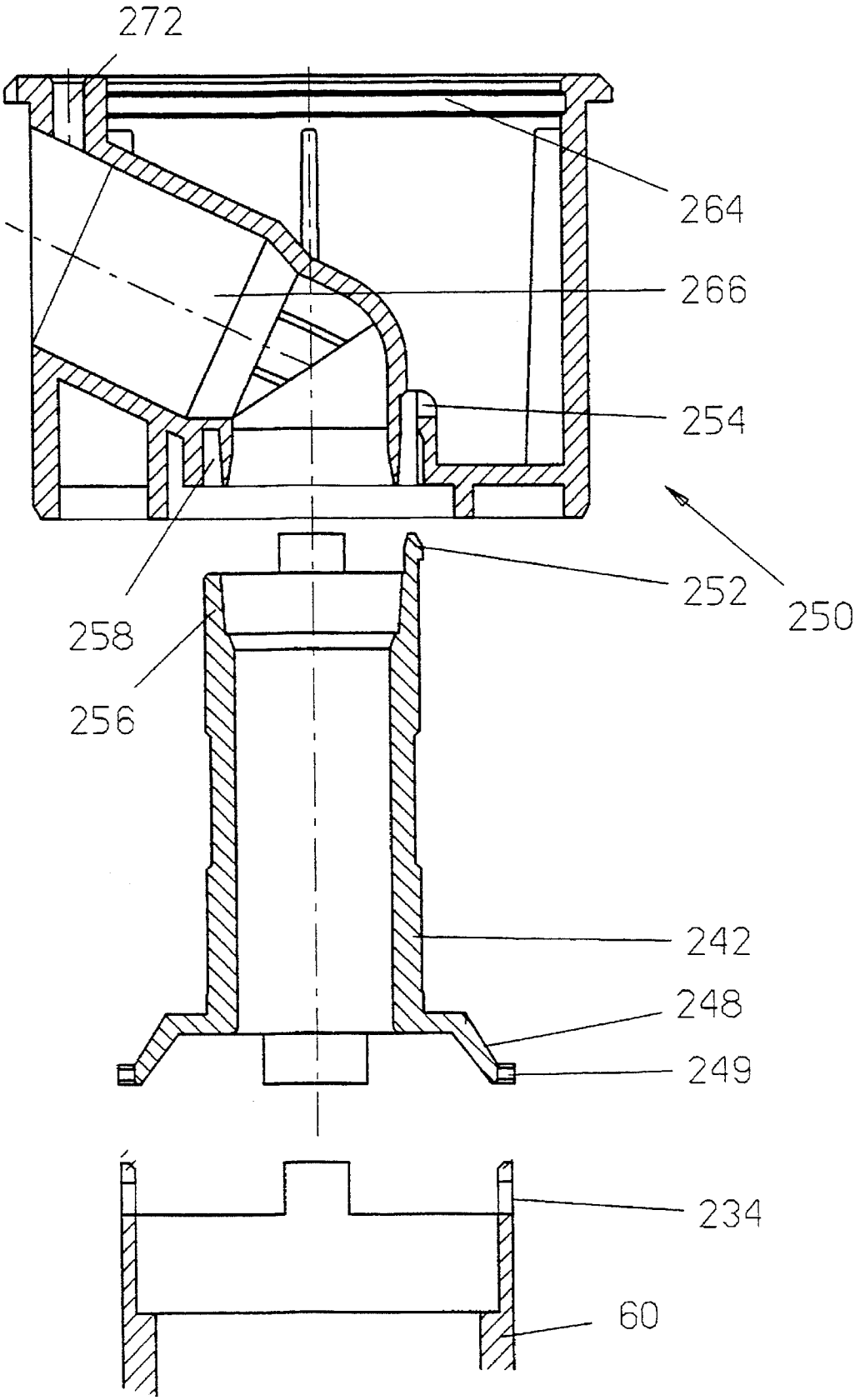
FIG. 9 is a simplified exploded view sectional illustration of the sprinkler head mounting of the sprinkler of FIG. 1.
Figure 10:
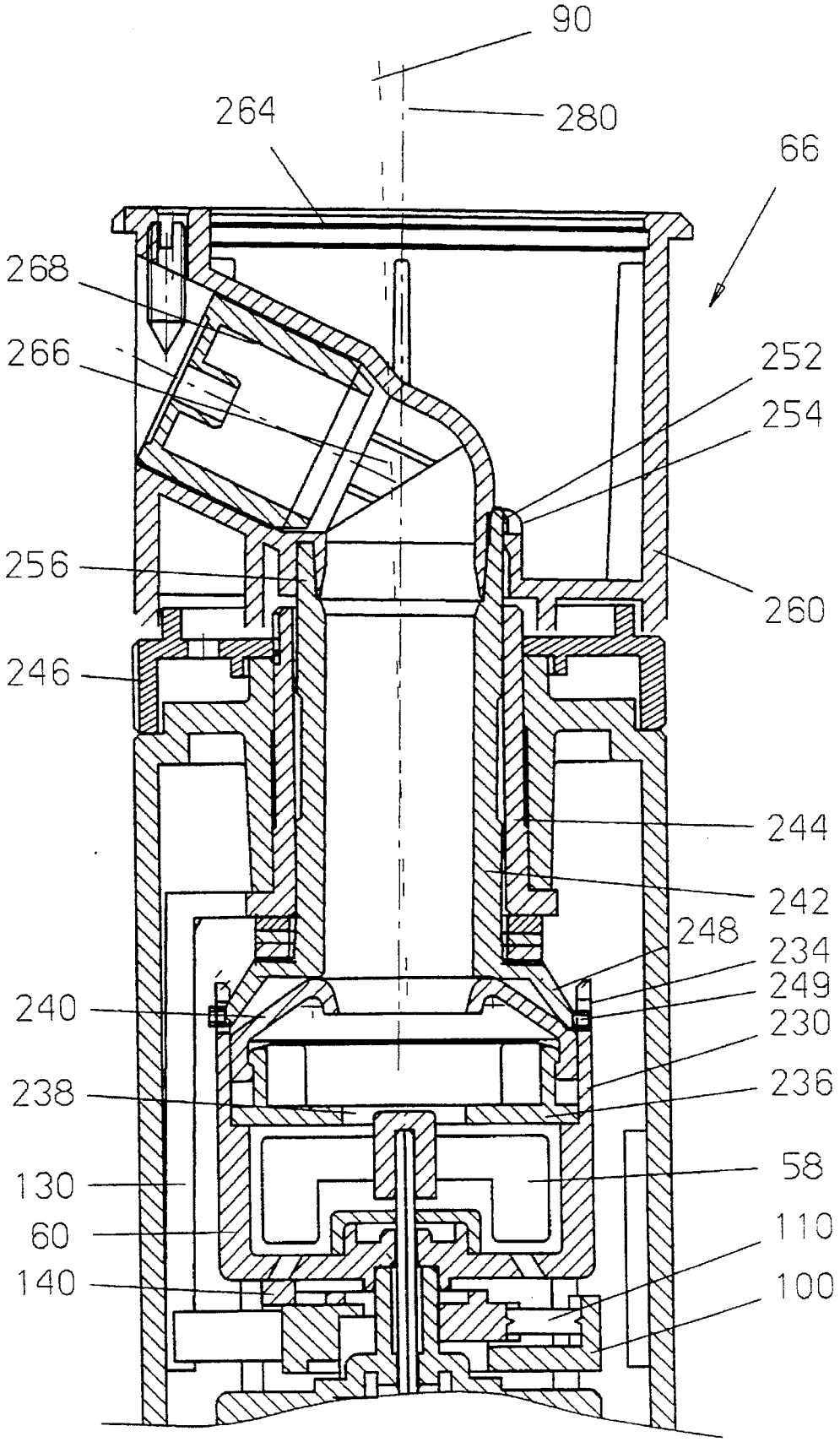
FIG. 10 is a sectional side view illustration of the sprinkler head portion of the sprinkler of FIG. 9 in an operative orientation.

Reference is now made additionally to FIGS. 9 and 10, which show the construction and operation of the sprinkler head. As seen in FIG. 1, housing 60 includes an upstanding cylindrical upper portion 230 which is formed with seating recess 234, whose function is described hereinbelow.

Disposed above turbine 58 within upper portion 230 is a retaining element 236, having a central aperture 238, which defines the water outlet from turbine 58. Retaining element 236 retains a generally conical valve element 240 which sealingly engages the bottom rim of a neck element 242, thus controlling the entry of water thereinto from the annular region between housing 60 and the bottom rim of the neck element 242.

Neck element 242 is supported within chassis 34 by means of a bearing sleeve 244 which is integrally formed with arm 130 and is sealingly mounted within chassis 34. Fixedly attached to sleeve 244 is a collar member 246 which is rotatably mounted onto chassis 34, to enable manual selection of the position of arm 130 relative to chassis 34 in order to enable a desired angular separation to be selected between rib 128 and arm 130. This selection determines the azimuthal range of operation of the sprinkler.

Preferably visible indications are provided on collar member 246 and on an exterior wall of chassis 34 to enable a user to readily directly visualize the azimuthal range of operation of the sprinkler.

Neck element 242 is provided with downwardly extending fingers 248 having outwardly extending end portions 249 which seat in corresponding recesses 234 in housing 60 and provide rotation of neck element 242 together with that of housing 60, while permitting limited off-axis movement of the neck element 242 relative to housing 60, as is seen in FIG. 10.

The limited off-axis movement of neck element 242 relative to housing 60 is provided by a loose coupling between end portions 249 and corresponding recesses 234.

Sealingly mounted onto the top of neck element 242 is a head unit 250. The mounting is preferably provided by engagement of a plurality of upstanding teeth 252, integrally formed with neck element 242, in corresponding sockets 254 in assembly 250. The teeth 252 extend from an upper rim 256. The upper rim 256 of neck element 242 is thus sealingly retaining in a corresponding rim socket 258.

Head unit 250 comprises a generally cylindrical side wall 260 which may be engaged by a separate cover member 264. A nozzle passageway 266 is formed in head unit 250 to extend generally continuously from the interior of neck portion 242 upwardly and then upwardly and sideways to an outlet location in wall 260. A separate nozzle element 268 is seated in the forward part of passageway 266 and may be retained by a flow dispersing screw 270, which is seated in a socket 272.

When a substantial flow of water passes out through nozzle element 268, the resulting reaction force tends to urge neck element 242 in an off-axis movement, which is permitted by the loose mounting described hereinabove. This off-axis movement is indicated in a somewhat exaggerated manner by arrow 280 in FIG. 10.

It is a particular feature of the present invention that impediments to motion of element 140, such as those caused by the presence of spurious particles, may be overcome by hand rotating of chassis 34 relative to housing 22, which effectively produces the operations illustrated in FIGS. 8A–8C.

Reference is now made additionally to FIG. 11, which shows part of a modified version of the apparatus of FIG. 10. In the embodiment of FIG. 11, there is disposed, above turbine 58 within upper portion 230, a retaining element 336 defining a central recess 337 which is open facing turbine 58 and which includes an outlet aperture 338, through which water leaves turbine 58. In accordance with one embodiment of the present invention, outlet aperture 338 may be made small enough to limit the water flow from the turbine and thus effectively limit the maximum speed of the turbine 58.

According to an alternative embodiment of the invention, the aperture 338 may be relatively large and a resilient flow limiting element 340 may be seated in recess 337. A preferred resilient limiting element 340 may be a rubber ring having a configuration which enables it to maintain the flow rate of water therepast and through aperture 338 generally constant notwithstanding pressure variations.

Retaining element 336 retains a generally conical valve element 240 which sealingly engages the bottom rim of a neck element 242. In view of the operation of recess 337, aperture 338 and resilient flow limiting element 340, valve element 240 need not control the entry of water into the turbine from the annular region between housing 60 and the bottom rim of the neck element 242. In such a case, valve element 240 functions to prevent water flow in parallel to the turbine until at least a predetermined water pressure is attained.

Figure 12A:
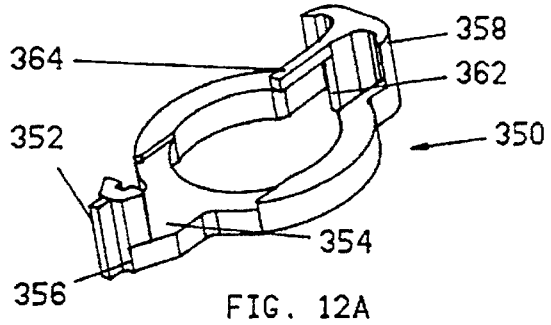
FIGS. 12A and 12B are pictorial illustrations of a modified version of the element shown in FIGS. 4A and 4B.

Reference is now made to FIGS. 12A–14E which illustrate a modified version of the apparatus of FIG. 6. FIGS. 12A and 12B show a link 350 which is a modified version of the link illustrated in FIGS. 4A and 4B. All of the elements of link 350 may be identical to those illustrated in FIGS. 4A and 4B and are indicated by the same reference numerals used there, other than as set forth hereinbelow:

The principal modification characterizing link 350 lies in relocation of the rectangular portion 122 of the second protrusion 112 in the link 100 as shown in FIGS. 4A and 4B. The rectangular portion is now indicated by reference numeral 352 and extends outwardly from an arm 356. Arm 356 is shown to be slightly narrower than corresponding arm 106 in the embodiment of FIGS. 4A and 4B.

Arm 356 is supported by a first protrusion 354, which corresponds to first protrusion 104 in the embodiment of FIGS. 4A and 4B and is broadened and tapered and formed with a shoulder 355.

Figure 12B:
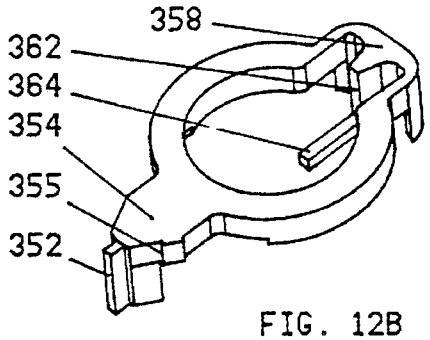

The second protrusion 112 of FIGS. 4A and 4B is modified additionally in the embodiment of FIGS. 12A and 12B in that it is moved radially outward and designated by reference numeral 358, surface 132 and finger 134 being redesignated by reference numerals 362 and 364 respectively. It is noted that finger 364 is lengthened accordingly.

Figure 13A:
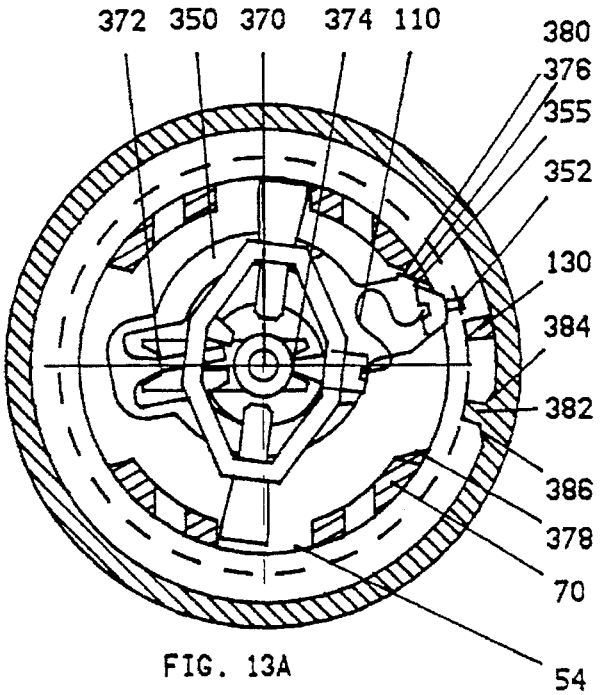
FIGS. 13A and 13B are simplified illustrations of a modified version of the apparatus shown in FIG. 6, taken generally in a direction indicated by arrows along lines VI—VI in FIG. 1, in two different orientations which illustrate resistance to damage from vandalism.
Figure 13B:
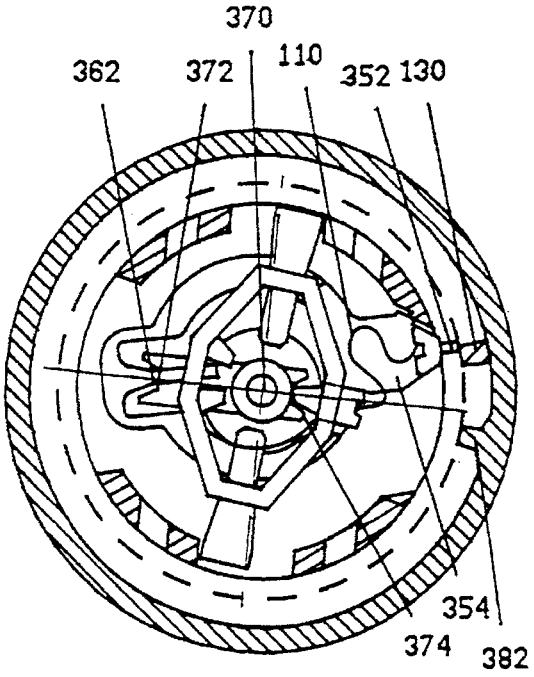

Turning now to FIGS. 13A and 13B, it is noted that as compared with the embodiment shown in FIGS. 7A–7C, axis 92 is further distanced from axes 90 and 94. These axes are indicated in FIGS. 13A and 13B by reference numerals 372, 370 and 374 respectively.

As compared with the embodiment shown in FIG. 3, two of peripheral edges 74 are angled differently and are indicated in FIGS. 13A and 13B by reference numerals 376 and 378. Additionally peripheral edge 376 is formed with a shoulder 380.

As compared with the embodiment shown in FIG. 1, inner facing rib 128 is modified to provide a pair of oppositely directed inclined surfaces. The modified rib is indicated in FIGS. 13A and 13B by reference numeral 382 and the inclined surfaces are indicated by reference numerals 384 and 386.

The structure of FIGS. 13A and 13B is particularly beneficial in providing resistance to damage caused by vandalism. This may be understood from the following explanation:

FIG. 13A illustrates the arrangement of the sprinkler for normal operation wherein the rectangular portion 352 extends radially outwardly to a sufficient degree so as to normally engage rib 382. If a vandal manually and forcibly rotates sprinkler head assembly 66 (FIG. 1), thus forcibly rotating housing 54 and peripheral tooth members 70 therewith, as well as link 350, rectangular portion 352 engages arm 130.

Upon such engagement, as seen in FIG. 13B, the inclined tapered surface of first protrusion 354 is forced against facing inclined edge surface 376, causing the entire element 350 to be displaced radially inward of arm 130, against the urging of spring 110. This displacement causes surface 362 to be displaced out of engagement with axis 372. In this way, breakage of rectangular portion 352, arm 130 or other parts of the sprinkler is prevented.

Figure 14A:
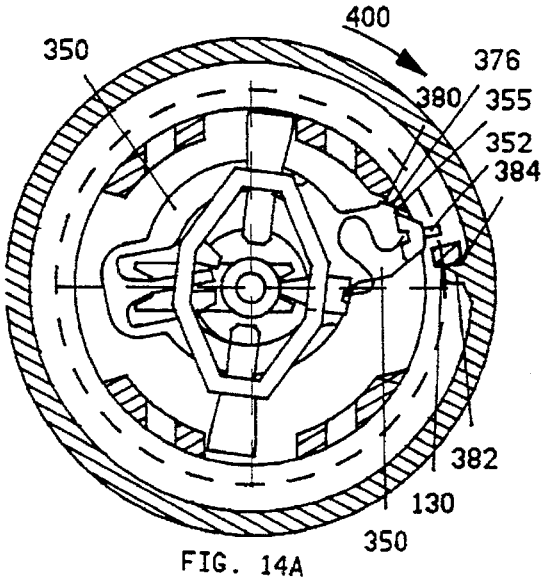
FIGS. 14A, 14B, 14C, 14D, 14E and 14F are illustrations of the modified version shown in FIGS. 13A and 13B in six different orientations which illustrate a technique for providing full and part circle operation of the sprinkler.

Reference is now made to FIGS. 14A–14F which illustrate certain aspects of the operation of the apparatus of FIGS. 13A and 13B. When the sprinkler is in operation and the chassis 34 is raised, an operator can manually engage collar member 246 in a direction indicated by an arrow 400, causing arm 130 to engage inclined surface 384 of protrusion 382, as seen in FIG. 14A.

The operator may then rotate the sprinkler head assembly 66 in the direction indicated by arrow 400, causing link 350 and thus rectangular portion 352 to engage arm 130. Upon such engagement, the inclined tapered surface of first protrusion 354 is forced against facing inclined edge surface 376, causing the entire element 350 to be displaced radially inward of arm 130, against the urging of spring 110. This radially inward displacement is greater than the displacement illustrated in FIG. 13B, inasmuch as arm 130 is, itself, located more radially inward than in the situation illustrated in FIG. 13B.

Figure 14B:
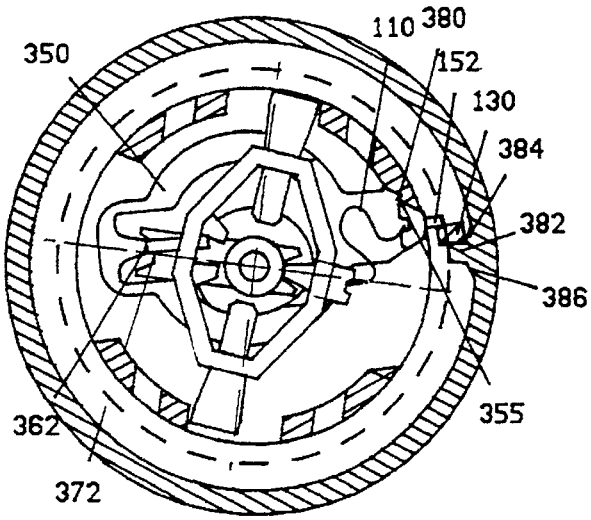

The radially inward displacement of element 350 is sufficient to produce engagement between respective shoulders 355 and 380, as shown in FIG. 14B.

Figure 14C:
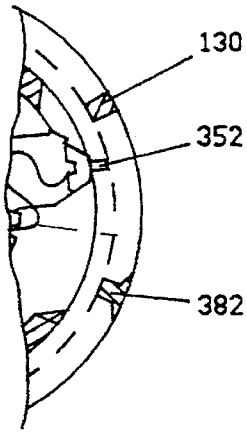

If thereafter, the operator releases and/or re-rotates collar member 246, returning arm 130 to its previous radial position, as exemplified in FIG. 14C, rectangular portion 352 is retained by the engagement of respective shoulders 355 and 380 and thus is free to rotate through 360 degrees without engaging either protrusion 382 or arm 130 and thus the sprinkler continues indefinitely in single direction motion.

Figure 14D:
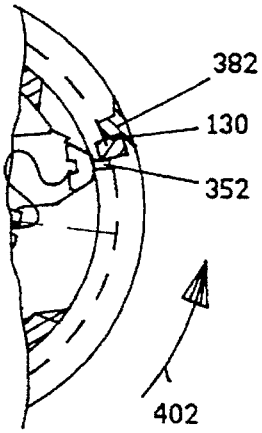

Returning the sprinkler to intermittent two-directional rotational motion may be accomplished by the operator rotating collar member 246 in a direction indicated by arrow 402, until it engages protrusion 382 and then rotating the sprinkler head assembly 66 in the direction of arrow 402 until the rectangular portion 352 engages arm 130, as seen in FIG. 14D.

Figure 14E:
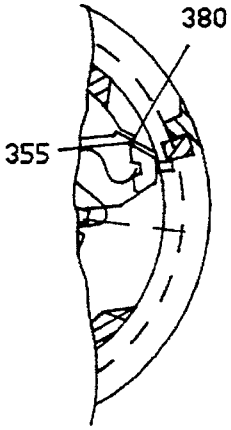
Figure 14F:
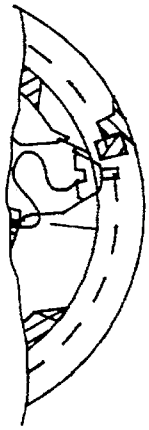

This engagement releases shoulder 355 from shoulder 380, as seen in FIG. 14E and enables the entire link 350 to assume its previous relatively radially outward position, as seen in FIGS. 14F and 14A, wherein engagement of rectangular portion 352 with arm 130 produces changes in the direction of sprinkler rotation.

It will be appreciated by persons skilled in the art that the present invention is not limited by what has been particularly shown and described hereinabove. Rather the scope of the present invention is defined only by the claims which follow:

We claim:

1. A pop-up sprinkler comprising:

an outer housing defining a water inlet;

an inner housing which is raised automatically in response to the supply of water under at least a predetermined pressure;

a water driven turbine disposed within said inner housing and driven by water entering the sprinkler via said water inlet;

a reducing gear assembly housing disposed within said inner housing and driven by said water driven turbine and having an output shaft fixed against rotation with respect to said inner housing, whereby operation of the water driven turbine causes the reducing gear assembly housing to rotate relative to the inner housing; and a rotatable water outlet fixed to the reducing gear assembly housing for rotation together therewith relative to said inner housing.

2. A sprinkler according to claim 1 and wherein said reducing gear assembly housing comprises a planetary gear.

3. A sprinkler according to claim 1 and also comprising snap fit attachment apparatus for joining said rotatable water cutlet to said reducing gear assembly housing for rotation together therewith.

4. A sprinkler according to claim 3 and also comprising a water supply pipe and wherein said snap fit attachment apparatus is coupled between said water supply pipe and said rotatable water outlet.

5. A sprinkler according to claim 1 and also comprising limiting apparatus for governing the amount of water leaving the turbine.

6. A sprinkler according to claim 5 and wherein said limiting apparatus comprises a valve element operative to maintain the flow rate of water therepast generally constant notwithstanding pressure variations.

7. A sprinkler according to claim 1 and also comprising apparatus for limiting the maximum outflow of water from said turbine.

8. A sprinkler according to claim 7 and wherein said apparatus for limiting comprises an element having a water outlet of a fixed size.

9. A sprinkler according to claim 1 and also comprising:

apparatus for selectably governing the direction of rotation of the rotatable water outlet and including:

a selector;

a link pivotable about a rotation axis fixed with respect to said turbine housing; and a spring operative to urge said link into an engagement orientation whereby it pivots about said rotation axis, and wherein forced relative rotation between at least two of said selector, said rotatable outlet and said housing forces said link against the urging of said spring and out of said engagement orientation with said rotation axis, and thus out of engagement with said selector, thereby preventing breakage of the link and the selector.

10. A sprinkler according to claim 1 comprising:

apparatus for selectably governing the direction of rotation of the rotatable water outlet and including:

a pair of mutually rotatable selectors including a link which is pivotable about a rotation axis fixed with respect to said turbine housing;

a spring operative to urge said link into an engagement orientation whereby it pivots about said rotation axis, and wherein predetermined relative rotation between said selectors forces said link against the urging of said spring and out of said engagement orientation with said rotation axis; and apparatus for retaining said link out of said engagement orientation, and thus out of engagement with said selectors, during normal working operation, thereby providing full circle sprinkler operation.

11. A sprinkler according to claim 1 and wherein said turbine has at least first and second water inlets whereby water entering said turbine via first and second water inlets produces operation of the turbine in respective first and second opposite rotational directions;

and also comprising water outlet rotation direction selection apparatus for selectably blocking one of the first and second inlets and including first and second elements being mounted for rotation about first and second mutually spaced rotation axes and being interconnected by an over-center spring mechanism, said first and second elements having portions which mutually engage each other at a location intermediate said first and second mutually spaced rotation axes, thereby to ensure desired mutual orientation of the first and second elements even under adverse environmental conditions.

12. A sprinkler according to claim 11 and wherein said first and second elements are arranged for rotation about their respective first and second rotation axes in respective opposite rotational directions, such that at said location intermediate said first and second mutually spaced rotation axes, said portions which mutually engage each other move together in the same direction.

13. A sprinkler comprising:

a housing defining a water inlet;

a water driven turbine driven by water entering the sprinkler via said water inlet;

a reducing gear assembly housing driven by said water driven turbine and having an output shaft fixed against rotation with respect to said housing, whereby operation of the water driven turbine causes the reducing gear assembly housing to rotate relative to the housing; and a rotatable water outlet fixed to the reducing gear assembly housing for rotation together therewith, and wherein said reducing gear assembly housing comprises a planetary gear.

14. A sprinkler according to claim 13 and wherein said turbine has at least first and second water inlets whereby water entering said turbine via first and second water inlets produces operation of the turbine in respective first and second opposite rotational directions; and also comprising water outlet rotation direction selection apparatus for selectably blocking one of the first and second inlets and including first and second elements being mounted for rotation about first and second mutually spaced rotation axes and being interconnected by an over-center spring mechanism, said first and second elements having portions which mutually engage each other at a location intermediate said first and second mutually spaced rotation axes, thereby to ensure desired mutual orientation of the first and second elements even under adverse environmental conditions.

15. A sprinkler according to claim 14 and wherein said first and second elements are arranged for rotation about their respective first and second rotation axes in respective opposite rotational directions, such that at said location intermediate said first and second mutually spaced rotation axes, said portions which mutually engage each other move together in the same direction.

16. A sprinkler according to claim 13 and also comprising snap fit attachment apparatus for joining said rotatable water outlet to said reducing gear assembly housing for rotation together therewith.

17. A sprinkler according to claim 16 and also comprising a water supply pipe and wherein said snap fit attachment apparatus is coupled between said water supply pipe and said rotatable water outlet.

18. A sprinkler according to claim 13 and also comprising limiting apparatus for governing the amount of water leaving the turbine.

19. A sprinkler according to claim 18 and wherein said limiting apparatus comprises a valve element operative to maintain the flow rate of water therepast generally constant notwithstanding pressure variations.

20. A sprinkler according to claim 13 and also comprising apparatus for limiting the maximum outflow of water from said turbine.

21. A sprinkler according to claim 20 and wherein said apparatus for limiting comprises an element having a water outlet of a fixed size.

22. A sprinkler according to claim 13 and also comprising:

apparatus for selectably governing the direction of rotation of the rotatable water outlet and including:

a selector;

a link pivotable about a rotation axis fixed with respect to said turbine housing; and a spring operative to urge said link into an engagement orientation whereby it pivots about said rotation axis, and wherein forced relative rotation between at least two of said selector, said rotatable outlet and said housing forces said link against the urging of said spring and out of said engagement orientation with said rotation axis, and thus out of engagement with said selector, thereby preventing breakage of the link and the selector.

23. A sprinkler according to claim 13 comprising:

apparatus for selectably governing the direction of rotation of the rotatable water outlet and including:

a pair of mutually rotatable selectors including a link which is pivotable about a rotation axis fixed with respect to said turbine housing;

a spring operative to urge said link into an engagement orientation whereby it pivots about said rotation axis, and wherein predetermined relative rotation between said selectors forces said link against the urging of said spring and out of said engagement orientation with said rotation axis; and apparatus for retaining said link out of said engagement orientation, and thus out of engagement with said selectors, during normal working operation, thereby providing full circle sprinkler operation.

24. A sprinkler comprising:

a housing defining a water inlet;

a water driven turbine driven by water entering the sprinkler via said water inlet and having at least first and second water inlet apertures whereby water entering said turbine via said first and second water inlet apertures produces operation of the turbine in respective first and second opposite rotational directions;

a rotatable water outlet driven by the water driven turbine;

water outlet rotation direction selection apparatus for selectably blocking one of the first and second water inlet apertures and including first and second elements being mounted for rotation about first and second mutually spaced rotation axes and being interconnected by an over-center spring mechanism, said first and second elements having portions which mutually engage each other at a location intermediate said first and second mutually spaced rotation axes, thereby to ensure desired mutual orientation of the first and second elements even under adverse environmental conditions.

25. A sprinkler according to claim 24 and wherein said first and second elements are arranged for rotation about their respective first and second rotation axes in respective opposite rotational directions, such that at said location intermediate said first and second mutually spaced rotation axes, said portions which mutually engage each other move together in the same direction.

26. A sprinkler according to claim 24 and also comprising apparatus for limiting the maximum outflow of water from said turbine.

27. A sprinkler according to claim 26 and wherein said apparatus for limiting comprises an element having a water outlet of a fixed size.

28. A sprinkler according to claim 24 and wherein said apparatus for selectably governing the direction of rotation of the rotatable water outlet includes:

a selector;

a link pivotable about a rotation axis fixed with respect to said turbine housing; and a spring operative to urge said link into an engagement orientation whereby it pivots about said rotation axis, and wherein forced relative rotation between at least two of said selector, said rotatable outlet and said housing forces said link against the urging of said spring and out of said engagement orientation with said rotation axis, and thus out of engagement with said selector, thereby preventing breakage of the link and the selector.

29. A sprinkler according to claim 24 and wherein said apparatus for selectably governing the direction of rotation of the rotatable water outlet includes:

a pair of mutually rotatable selectors, including said link which is pivotable about a rotation axis fixed with respect to said turbine housing; and apparatus for retaining said link out of engagement with said selectors, during normal working operation, thereby providing full circle sprinkler operation.

* * * * *